US006729394B1

(12) United States Patent
Hassan et al.

(10) Patent No.: US 6,729,394 B1
(45) Date of Patent: May 4, 2004

(54) METHOD OF PRODUCING A COMMUNICATING HORIZONTAL WELL NETWORK

(75) Inventors: David J. Hassan, Calgary (CA); Michael D. Chernichen, Airdrie (CA); Earl M. Jensen, Calgary (CA)

(73) Assignee: BP Corporation North America Inc., Warrenville, IL (US)

( * ) Notice: Subject to any disclaimer, the term of this patent is extended or adjusted under 35 U.S.C. 154(b) by 0 days.

(21) Appl. No.: 09/403,350

(22) PCT Filed: May 1, 1997

(86) PCT No.: PCT/US97/07368

§ 371 (c)(1),
(2), (4) Date: Jan. 7, 2000

(87) PCT Pub. No.: WO98/50679

PCT Pub. Date: Nov. 12, 1998

(51) Int. Cl.[7] ..... E21B 43/30; E21B 43/16
(52) U.S. Cl. ..... 166/245; 166/268; 166/52
(58) Field of Search ..... 166/245, 268, 166/52, 901, 313, 271, 272.1, 272.3, 272.7, 305.1, 308

(56) References Cited

U.S. PATENT DOCUMENTS 4,344,485 A * 8/1982 Butler ..... 166/271
4,522,260 A * 6/1985 Wolcott, Jr. ..... 166/245
4,574,884 A * 3/1986 Schmidt ..... 166/263
4,621,691 A * 11/1986 Schuh ..... 166/268
5,016,709 A * 5/1991 Combe et al. ..... 166/245
5,025,859 A * 6/1991 Hanson et al. ..... 166/252.1
5,033,546 A * 7/1991 Combe ..... 166/245
5,133,410 A * 7/1992 Gadelle et al. ..... 166/308
5,244,041 A * 9/1993 Renard et al. ..... 166/268
5,273,111 A * 12/1993 Brannan et al. ..... 166/245
5,456,315 A * 10/1995 Kisman et al. ..... 166/245
5,626,191 A * 5/1997 Greaves et al. ..... 166/245
5,899,274 A * 5/1999 Frauenfeld et al. ..... 166/401
6,012,520 A * 1/2000 Yu et al. ..... 166/245
6,095,244 A * 8/2000 Graham et al. ..... 166/272.2
6,119,776 A * 9/2000 Graham et al. ..... 166/245
6,439,320 B2 * 8/2002 Zupanick ..... 175/61

* cited by examiner

*Primary Examiner*—David Bagnell
*Assistant Examiner*—Shane Bomar
(74) *Attorney, Agent, or Firm*—James A. Gabala

(57) ABSTRACT

A method of producing fluids from a subterranean formation through a single well in a network of separate well-bores, comprising the steps of: forming a well having a horizontal section located within the formation; completing and equipping such well to produce fluids from the formation; producing fluids from the formation through such well; forming at least one additional well having a horizontal section located within the formation such that such well is in fluid communication with the first well, without intersecting with the horizontal section of the first well, and using such additional well as an conduit within the formation to allow and cause fluids contained in the formation which drain or flow into the horizontal section of such additional well-bore, to flow to and be produced through the first well-bore.

17 Claims, 8 Drawing Sheets

METHOD OF PRODUCING A COMMUNICATING HORIZONTAL WELL NETWORK

TECHNICAL FIELD

This invention relates to the general subject of methods and devices for recovering fluids from subterranean formations, and, in particular, to processes and apparatus for recovering bitumen, heavy crude oil and other hydrocarbons by means of horizontal wells drilled from surface locations.

BACKGROUND OF THE INVENTION

It is well known that the use of horizontal wells drilled from surface locations has improved the economics and reduced the environmental impact of finding and recovering hydrocarbons and other substances from subterranean formations. A horizontal well is a well that is formed with a section of the well being oriented relatively or approximately in a geometric plane that is parallel to the surface of the earth beneath which such section is located. In particular it is well known that in appropriate applications, a single horizontal well can expose and access as much of the mineral bearing rock in a subterranean formation as several vertical wells. A vertical well is a well which is not comprised in whole or in part of a horizontal section as described above, and includes a deviated or slant hole well formed or drilled from the surface of the earth.

The cost of drilling and completing a single horizontal well into a particular formation, generally exceeds the cost of drilling and completing a vertical well into the same formation. However substantial economies of scale can be achieved where the use of horizontal wells significantly reduces the number of wells required to efficiently produce the hydrocarbons contained in a subterranean reservoir. These savings accrue as a result of reduced capital and operating costs for developing and producing a mineral bearing subterranean formation. For an excellent summary of the art and advantages of producing a subterranean reservoir using horizontal wells, see:

Butler, R. M., "The Potential for Horizontal wells for petroleum production", Journal of Canadian Petroleum Technology, May–June 1989, Volume 28, No. 3, pp.39–47;

Deskins, W. G, Reid, T. B. and McDonald, W. J., "Success of Horizontal Well Technology in Heavy Oil Applications", 6$^{th}$ UNITAR International Conference on Heavy Crude and Tar Sands, Feb. 12–17, 1995, Houston Tex., USA, Volume 1, pp. 495–503; and Thakur, G. C., "Horizontal Well Technology—A Key to Improving Reserves", paper delivered at the SPE/CIM 5$^{th}$ Annual One-day Conference on Improvement in Horizontal Well Productivity and Profitability, Calgary, Alberta, Canada, Nov. 21, 1995.

A hydrocarbon bearing subterranean formation is usually developed and produced through wells formed from locations on the surface of the earth overlying such formation. It is well known that the use of horizontal wells can reduce the number of wells required to accomplish such development and production which in turn, can correspondingly reduce the number and areal extent of well sites and access roads required to form and support such wells. As a result the cost and environmental impact of developing and producing a hydrocarbon bearing subterranean formation can be reduced.

It is well known in the art that a subterranean reservoir containing hydrocarbons or other valuable substances which are fluid in nature or may be reduced to or carried in a fluid, can be produced efficiently through a network of horizontal well-bores. A means of exploiting and producing substances contained in a subterranean reservoir through a network of horizontal wells is disclosed in U.S. Pat. No. 4,621,691 to Shuh. However the method taught by Shuh requires that each horizontal well be drilled from a separate well site, and completed, equipped and operated as a separate individual well.

As improvements in technology have facilitated the drilling of horizontal wells of increasing length and at shallower depths, further reductions in the environmental impact and economic cost of developing a subterranean hydrocarbon reservoir have been achieved by drilling multiple horizontal wells from the same well site or drilling "pad" (see Sadler, K. W. and Houlihan, R. N. "An Energy Resources Conservation board Review of Oil Sands Development in Alberta, 6$^{th}$ UNITAR International Conference on Heavy Crude and Tar Sands, Feb. 12–17, 1995, Houston Tex., USA, Volume 1, p. 95-103, at pp.101 & 102). In these instance the well-bore of each well drilled from the pad is characterized by having its own vertical, build and horizontal sections. The vertical section lies approximately perpendicular to the surface of the earth from which the well is formed. The horizontal section lies approximately parallel to the surface of the earth. The build section is the portion of the well-bore which connects the horizontal section and the vertical section. Although multiple well-bores may be formed from a single well site, frequently each well-bore is completed, equipped and operated as a separate individual well. By completing, it is meant that steps are taken to prevent: (i) the collapse of the well-bore, (ii) the infiltration of substances into the well-bore from formations other the target formation, (iii) the ex-filtration of substances from the well-bore into formations other the target formation, and (iv) the uncontrolled escape of substances from the subterranean formations penetrated by the well-bore. By equipping, it is meant that steps are taken to prepare the well-bore to be used to inject or produce substances, into or from the subterranean formation, as the case may be. This includes the placing of pumps, production or injection tubing and other equipment into the well-bore and the installation and connection of tanks, pumps, surface piping or other equipment at surface on the well site and to the well-bore as the case may be.

To overcome the need to complete and equip each well formed from a pad site, advances in the art discloses the forming of multiple well-bores from a single vertical shaft and the apparatus required to form, operate and maintain such multiple well-bores. This allows more of the reservoir to be accessed from a single well site using a network of multiple horizontal well-bores that share a common vertical section. This further reduces the amount of surface disturbance. The size of the well site required to support multiple horizontal well-bores formed and operated in this fashion, may be smaller than the well site required to form and operate a similar number of horizontal well-bores formed from individual vertical sections. See:

Maurer, W. C., "Recent Advances in Horizontal Drilling", The Journal of Canadian Petroleum Technology, Nov. 1995, Volume 34, No. 9, pp. 25–33.

Brockman, M. and Gann, C., "Multilateral Completions Prepare to Take Off", Petroleum Engineer International, January 1996, pp. 49–50.

Themig, D., "Planning And Evaluation Are Crucial To Multilateral Wells", Petroleum Engineer International, January 1996, pp. 53–57.

Collins, D., "Single-Size Reduction Offers Workover, Completion Advantages", Petroleum Engineer International, January 1996, pp. 5942.

Von Flatern, R., "Operators Are Ready For More Sophisticated Multilateral Well Technology", Petroleum Engineer International, January 1996, pp. 6549.

Sperry-sun Drilling Services Brochure "Horizontal Drilling; Multilateral and Twinned Wells", copyright 1993, Sperry-Sun Drilling Services Inc.

U.S. Pat. No. 4,020,901 to Piso et al

U.S. Pat. No. 4,022,279 to Driver

U.S. Pat. No. 4,160,481 to Turk et al

U.S. Pat. No. 4,257,650 to Allen

U.S. Pat. No. 4,379,592 to Vakhnin et al

U.S. Pat. No. 4,434,849 to Allen

U.S. Pat. No. 4,442,896 to Reale et al

U.S. Pat. No. 4,458,945 to Ayler et al

U.S. Pat. No. 4,463,988 to Bouck et al

U.S. Pat. No. 4,519,463 to Schuh

U.S. Pat. No. 4,595,239 to Ayler et al

U.S. Pat. No. 4,611,855 to Richards

U.S. Pat. No. 4,753,485 to Goddhart

U.S. Pat. No. 4,982,786 to Jennnings Jr.

U.S. Pat. No. 5,115,872 to Brunet et al

U.S. Pat. No. 5,123,488 to Jennings Jr.

U.S. Pat. No. 5,311,936 to McNair et al

U.S. Pat. No. 5,330,007 to Collins et al

U.S. Pat. No. 5,394,950 to Gardes

U.S. Pat. No. 5,425,429 to Thompson

U.S. Pat. No. 5,427,177 to Jordan Jr. et al

U.S. Pat. No. 5,435,392 to Kennedy et al

U.S. Pat. No. 5,458,199 to Collins et al

U.S. Pat. No. 5,458,209 to Hayes et al

U.S. Pat. No. 5,474,131 to Jordan, Jr. et al

U.S. Pat. No. 5,477,293 to Jordan, Jr. et al

U.S. Pat. No. 5,526,880 to Jordan, Jr. et al

U.S. Pat. No. 5,533,573 to Jordan, Jr. et al

However, practice of the methods and apparatus disclosed by the foregoing art is expensive and requires the employment of complicated mechanisms and procedures. The construction of a network of horizontal well-bores according to the foregoing art, requires that all well-bores must communicate by physically intersecting or connecting. By communicate, it is meant that fluids, either gas or liquid, which enter one well-bore in the network, may flow or drain to another well-bore in the network. By intersecting or connecting, it is meant that each well-bore is directly joined or coupled to: (i) at least one other horizontal well-bore to form a continuous bore hole composed of such joined or coupled well-bores, or (ii) a common shared vertical section.

Due to limitations in drilling technology, the area of the reservoir that can be accessed and produced through the practice of current multi-well technology is limited. Also the efficient employment of these technologies to form a network of communicating horizontal wells usually requires that the entire network be constructed before employing the network to produce substances from the target reservoir. In most cases the construction of the network in phases, while physically possible, is usually not economic.

Other technologies disclosed by the art attempt to overcome these limitations by disclosing intersecting well-bores drilled separately from different locations. See:

U.S. Pat. No. 3,386,508 to Bielstein et al

U.S. Pat. No. 3,513,913 to Bruist

U.S. Pat. No. 3,892,270 to Lindquist

U.S. Pat. No. 3,986,557 to Striegler

U.S. Pat. No. 4,007,788 to Striegler

U.S. Pat. No. 4,016,942 to Wallis, Jr. et al

U.S. Pat. No. 4.037,658 to Anderson

U.S. Pat. No. 4,220,203 to Steeman

U.S. Pat. No. 4,368,781 to Anderson

U.S. Pat. No. 4,390,067 to Willman

U.S. Pat. No. 4,442,896 to Reale

U.S. Pat. No. 4,511,000 to Mims

U.S. Pat. No. 4,532,986 o Mims et al

U.S. Pat. No. 5,016,710 to Renard et al

U.S. Pat. No. 5,074,360 to Guinn

U.S. Pat. No. 5,402,851 to Baiton

U.S. Pat. No. 5,450,902 to Mathews

This allows the network of wells to be formed in phases. However this still requires that the well-bores must connect or intersect. In practice, this has proven expensive and difficult to implement. What is required is an alternative method that will allow a large area of a subterranean reservoir to be accessed through and affected by a network of horizontal well-bores without:

(i) using complex and expensive drilling, completion and production equipment and techniques;

(ii) having to intersect or connect each well-bore with the other well-bores in the network;

(iii) having to equip and operate each well-bore separately; and (iv) having to construct the entire network immediately before being able to utilize any portion of the network.

U.S. Pat. No. 4,522,260 to Wolcott, Jr. teaches the formation of a network of horizontal well-bores and the use of explosives detonated in such well-bores in order to rubblize the solid material comprising the reservoir. Wolcott teaches that the rubblizing of the formation creates improved permeability in the reservoir, thereby allowing fluids to more readily flow or drain from the reservoir into the wells. However, the rendering of a solid or consolidated reservoir matrix into an unconsolidated matrix, would not provide a sufficient enhancement to the ability of liquids to flow through the reservoir. Those skilled in the art will realize that in order for liquids to flow efficiently through a subterranean reservoir, a channel or conduit must exist or be created.

Furthermore, much of the world's heavy crude oil and bitumen deposits are found in reservoirs comprised of unconsolidated materials, such as oil sands. The instability of the reservoir matrix in these situations makes the application of Wolcott impossible. Those skilled in the art will also realize that the method taught by Wolcott would be difficult to apply to a thin reservoir. For example, in the Wabasca Area of Alberta, Canada, heavy crude oil has been found and produced from reservoirs less than 6 metres in thickness. The detonation of any significant amount of explosive in such a thin reservoir would risk rupturing the impermeable layers of rock which underlie and overlay the reservoir.

The practice of Wolcott in a reservoir comprised of consolidated materials, would result in the collapse of substantial portions of the horizontal sections of the well-bores comprising the network of wells formed according to this method. This is a natural result of transforming the consolidated reservoir matrix into an unconsolidated matrix.

Finally Wolcott does not teach any method of reducing the cost and environmental impact of producing fluids from a reservoir through a network of wells. Wolcott does not prescribe using less than all wells in the network to produce fluids from the reservoir. Wolcott refers to the application of methods known in the art to accomplish such production of fluids.

It is well known in the art, that the use of vertical or horizontal wells to produce fluids from a subterranean formation comprised of unconsolidated material, will frequently result in the production of solid material from the formation with the fluid. In many instances this has been observed to result in the formation of conduits within the formation. It is believed that the formation of such conduits can extend the area of the formation affected by an individual well. By conduit, it is meant that a channel or passage is created within and relatively free of the solid material which comprises the subterranean formation. See:

Smith, G. E., "Fluid Flow in Heavy Oil Reservoirs Under Primary Depletion and Their Apparent Enhanced Permeability", Presented at the SEG/SIAM/SPE Conference entitled, Mathematical and Computations Methods In Seismic Exploration and Reservoir Modeling, held January 21–24, 1985, in Houston Tex., USA Smith, G. E., "Sand Production By Gross Formation Failure", Presented at the CIM Lloydminster Heavy Oil Seminar, held Nov. 5, 1985, in Lloydminister, Alberta, Canada.

Squires, A., "Inter-well Tracer Results and Gel Blocking Program Clearwater Reservoir, Elk Point, Alberta", Presented at the Canadian Heavy Oil Association Tenth Annual Heavy Oil & Oil Sands Technical Symposium, Mar. 9, 1993

The formation of such conduits can greatly extend the area of the reservoir which can be accessed and affected by the wells connected to such conduits. However, conduits formed in the manner described in the foregoing art are unreliable, as the direction, extent and stability of such conduits cannot be controlled or maintained. Furthermore, as disclosed in the foregoing articles, the uncontrollable nature of such naturally formed conduits can be detrimental to the production of hydrocarbons from a reservoir.

It is also well known in the art, that one o the major problems encountered in drilling a horizontal well, is the loss of circulation. This occurs when large volumes of drilling fluid escape into the formation being penetrated by the drill string. When drilling a horizontal well in the vicinity of existing well-bores which are being produced or have been produced, the loss of circulation is common. Frequently the production of fluids from existing offsetting wells must be temporarily suspended while drilling operations of the new well are under way, in order to mitigate the possibility of loss of circulation occurring, or the contamination of offsetting producing wells with drilling fluid.

It is an objective of the apparatus and process described herein to take advantage of both of the foregoing phenomena, by teaching the construction and operation a network of communicating horizontal wells without requiring the employment of complex equipment and processes, and without the need for such wells to intersect. Such a method and apparatus has particular application in the production of heavy viscous fluids such a bitumen and heavy crude oil. Such a method and apparatus could also be applied in the production of solid minerals using a wash or leaching process.

SUMMARY OF THE INVENTION

In accordance with the present invention, a method and apparatus is provided for producing fluids from a large area of a subterranean formation through a network of individual horizontal well-bores without:

(i) using complex and expensive drilling, completion and production equipment and techniques to form, operate and maintain such network;

(ii) having to intersect or connect each well-bore with the other well-bores in the network;

(iii) having to equip and operate each well-bore separately; and (iv) having to construct the entire network immediately before being able to utilize any portion of the network.

The method comprises the steps of: (i) forming a main well-bore having a horizontal section that is located within the formation; (ii) completing and equipping the main well-bore to produce fluids from the formation; (ii) forming one or more additional and separate horizontal well-bores such that the horizontal section of each such additional well-bore is in fluid communication with the horizontal section of the main well-bore without intersecting or connecting with such main well. Only the main well-bore is initially completed and-equipped to produce fluids. However the additional well-bores may be completed to the extent required by government regulation, the art and conditions within the formation. Initially, the additional well-bores are not equipped. The well-bores of these additional or conduit wells act as artificial conduits within the reservoir facilitating the flow of fluids through the reservoir to the well-bore of the main well. By fluids it is meant to include gaseous or liquid substances contained or introduced into a subterranean reservoir or substances contained in the reservoir which can be rendered into a gaseous or liquid phase in-situ within the reservoir, including bitumen, crude oil, heavy crude oil or natural gas.

If the main well-bore fails and can no longer be used to produce substances from the formation, one or more of the additional well-bores may be equipped to produce substances from the formation. In such event the additional well-bore so equipped replaces the main well-bore in function and apparatus It is also possible that in certain applications of the foregoing described process and apparatus, that more than one but not all wells comprising the network, may be completed, equipped and operated in the production of substances from the subterranean formation.

Once the main well-bore has been formed, additional well-bores are formed in sequence. In one embodiment, each additional well-bore is formed such that the horizontal section of such additional well-bore is formed towards or in the direction of the horizontal well-bore of the main well-bore or the horizontal section of an existing additional well-bore which is already in fluid communication with the main well-bore. Prior to and during the forming of an additional well-bore production of fluids from the formation through main well-bore commences and continues. Fluid communication with the main well-bore is determined when drilling fluid being used to form the additional well-bore appears in the fluid being produced from the main well-bore. When this happens loss of circulation in the additional well-bore has or is occurring and further construction of the additional well-bore ceases. To ensure that fluid communication is achieved between the main well-bore and the additional well-bore during the forming of the additional well-bore, it is advisable to produce fluids from the main well-bore for a period of time before commencing to form the additional well-bore.

Where fluid communication between the main well-bore and the additional well-bore, cannot be achieved during the forming of the additional well-bore, then the drilling of the additional well-bore should continue until the horizontal section of the additional well-bore, overlaps or crosses over the horizontal section of the main well-bore or the horizontal section of any existing additional well-bore which is already in fluid communication with the main well-bore. By crosses over, it is meant that the well-bore of the additional well crosses through the vertical plane in which the horizontal section of the main well approximately lies, without intersecting the horizontal section of the main well. By overlaps, it is meant that the well-bore of the additional well lies approximately in the vertical plane in which the horizontal section of the main well approximately lies, without intersecting the horizontal section of the main well.

Where such overlapping or crossing occurs without fluid communication occurring during the forming of the additional well-bore, then communication between the additional well-bore and the main well-bore must be established by the application of means know in the art. This could include the use of techniques such as hydraulic fracturing, perforation or jet washing of a portion of the material comprising the reservoir lying between the horizontal section of the additional well-bore and horizontal section of either the main well-bore or an existing additional well-bore which is already in fluid communication with the main well-bore.

In this manner a large area of the formation may be accessed and produced through a single horizontal well-bore, in communication with a network of horizontal wells, which can be expanded over time or created at once in a shorter period of time. Similarly such a network of communicating horizontal well-bores formed in this manner, may be utilized to inject solvents, heat bearing fluids, reactive fluids or leaching fluids into a formation and produce back such fluids and substances from the formation, through the main well-bore. In this situation, the main well-bore is completed and equipped to both inject and produce fluids from the formation, although in some applications it may not be desirable or necessary to complete and equip such well-bore to inject fluids. The additional well-bores when formed are initially completed and equipped to inject fluids only. Conduct of the fluid injection process can proceed simultaneously through all well-bores or sequentially depending on the nature of the injection fluid and desired result of the fluid injection. The conduct of the injection/production process is continuous until the economic limit for production of fluids from the reservoir is reached. Where the additional well-bores are not initially equipped for the production of substances from the formation, only a small permanent well site may be required at the surface location of each additional well-bore. Where it is not necessary or desirable to access the horizontal section of the additional well-bores subsequent to the forming of the additional well-bores, it may be possible to complete the horizontal section of each additional well-bore and abandon the build and vertical sections of the additional well-bores. This would eliminate the need to construct or maintain a permanent well site for each additional well-bore. Even where a permanent well site is constructed and maintained for the additional well-bores, these wells may not require permanent all weather access roads.

The elimination of permanent well sites and access roads and the reduction of the size of the of the permanent well site is of significant benefit to the environment. For example, in northern muskeg or tundra bearing terrain, the cost and environmental impact of producing heavy crude oil and bitumen through the drilling and operating of a network of wells, can be reduced by drilling the additional well-bores and accessing the wells sites for such well-bores, in the winter over frozen ground. Only the main well-bore, as it is the producing well-bore for the network, requires permanent access and a large permanent well site.

Further environmental benefits can be achieved in terms of the reduction in green house gas emissions. For example in the production of heavy crude oils or bitumen, small amounts of methane and other gases are produced at the well site, in conjunction with the oil being extracted from the reservoir. These gases are frequently vented to the atmosphere, as they do not occur in large enough quantities at any individual well site to physically collect and recover. By producing a heavy oil or bitumen bearing reservoir utilizing a single producing well communicating with a network of wells, the volume of gas production, which is linked to the volume of oil production, can become significant enough to enable the recovery and conservation of the gas. Similarly well site production equipment frequently incorporates heaters and other devices which burn hydrocarbon fuel. The use of a single well to produce a network of communicating well bores, reduces the amount of $CO_2$ being emitted by reducing the number of smaller less efficient well site bumers. Utilizing a single well site with larger more energy efficient production equipment should achieve greater fuel efficiency per barrel of heavy oil, or bitumen produced. Additional green house gas reductions can be achieved, where fluids produced from the reservoir and collected on the surface, such as heavy crude oil or bitumen, must be transported by truck from the point of production, to a remote facility for further processing or sale. Utilizing a single well to produce and collect fluids from a network of communicating wells reduces the distance and trucking time required to gather and transport fluids produced from the network.

Therefore the application of this invention enables a large area of a subterranean formation to be accessed and produced at reduced capital, operating and environmental costs.

DETAILED DESCRIPTION

Figure 1:
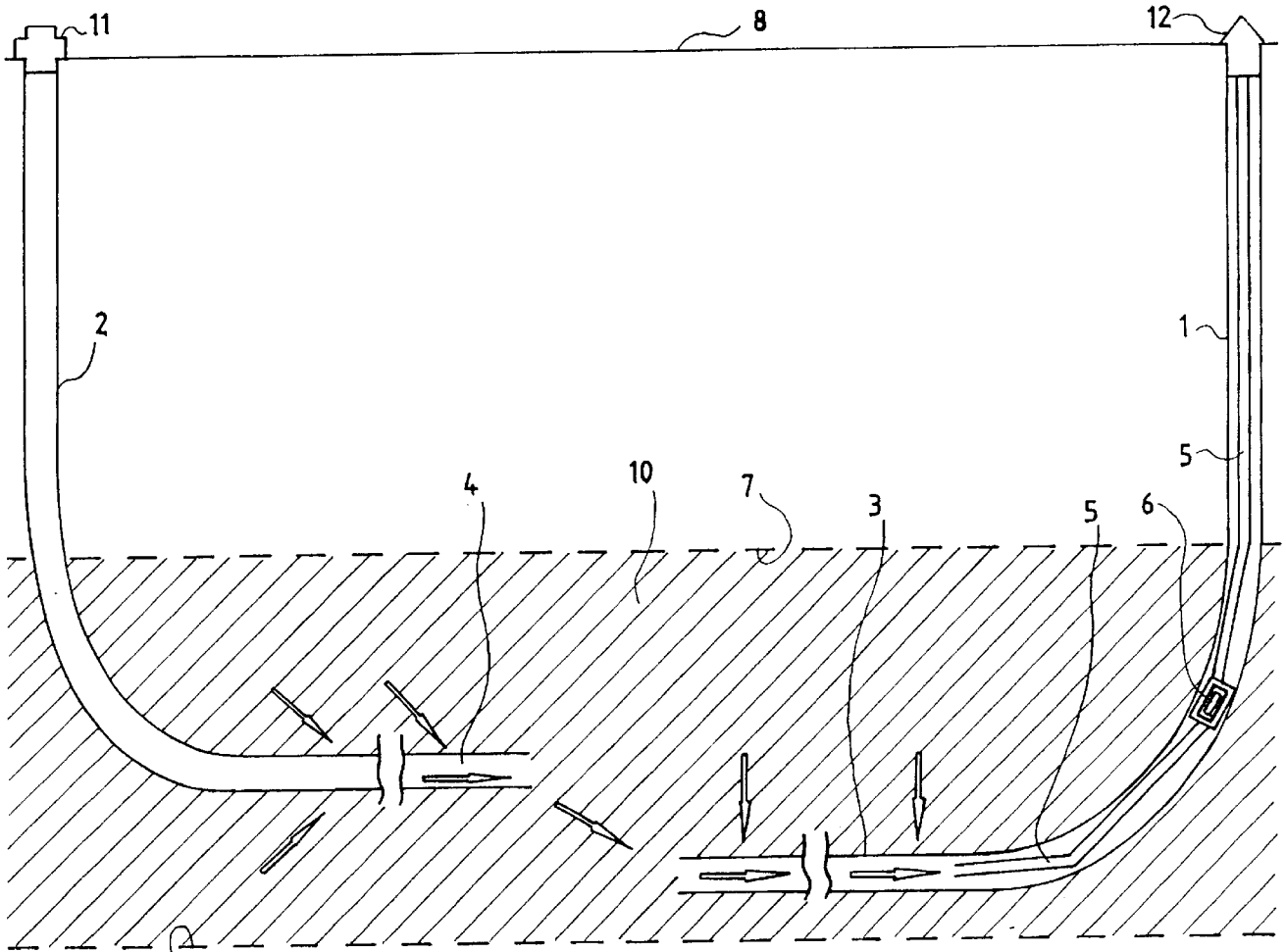
FIG. 1 shows, by side view, the approximate geometry of a simple horizontal well network formed in accordance with the present invention, where the two horizontal well-bores do not overlap.

While this invention is susceptible of embodiment in many different forms, there is shown in the drawings, and will herein be described in detail, several specific embodiments of the invention. It should be understood, however, that the present disclosure is to be considered an exemplification of the principles of the invention and is not intended to limit the invention to any specific embodiment so described.

Referring to FIG. 1 there is illustrated a single horizontal main well ("main well") formed in a subterranean reservoir 10 ("target reservoir"). The target reservoir is bounded by relatively impermeable upper and lower boundaries 7 and 9 and is composed of permeable materials containing hydrocarbons. The target reservoir shown is exemplary for this process. Not all reservoirs will have this exact structure. Those skilled in the art know that reservoirs containing hydrocarbons can vary significantly in depth, location, nature, composition and structure. Neither is this invention limited to producing hydrocarbons from a subterranean reservoir. Those skilled in the art will appreciate that this invention could be applied to produce a variety of fluids contained in a subterranean reservoir. Also this invention could be applied to produce solid subterranean occurring minerals which can be dissolved in a solvent or carried in suspension in a fluid, or rendered capable of flowing by the application of heat.

The main well is formed from the surface 8 using means known in the art. The vertical depth and horizontal length of the well is dependent upon the depth, location, composition and nature of the target reservoir. The vertical depth of the main well should be sufficient to allow for placement of the approximately horizontal portion of the well-bore 3 as described hereafter. The main well is formed so that the approximately horizontal section of the main well is located above the base 9 of the target reservoir. However the exact location of the horizontal section of the main well within the target reservoir will depend on the nature, depth and composition of the target reservoir, the type of hydrocarbons contained in the target reservoir, and the type of production process to be used to extract such hydrocarbons from such reservoir.

The main well is completed and equipped using means known in the art to produce fluids from target reservoir. The main well may be formed specifically for the implementation of the process and apparatus described herein. The main well may also be an existing well which was initially formed and used for other purposes. However the main well must be completed and equipped to produce fluids from target reservoir, in order to implement the process and apparatus taught herein. The manner and type of completion and equipping will depend on the nature, depth and composition of the target reservoir, type of hydrocarbons contained in the target reservoir, and the type of production process to be used to extract such hydrocarbons from such reservoir. In FIG. 1, the main well is completed to produce fluids by means of production tubing 5 and pump 6. Other methods and forms of completion and equipping are possible in the practice of this invention.

Subsequent to the formation of the main well, horizontal well 2 ("conduit well") is formed through means known in the art. The conduit well is formed from the surface 8. The conduit well has an approximately horizontal section The vertical depth and horizontal length of the well is dependent upon the depth, location, composition and nature of the target reservoir. However, a horizontal length in excess of 300 feet is preferred. The vertical depth of the conduit well should be sufficient to allow for placement of the approximately horizontal portion of the well-bore 4 as described hereafter. The conduit well is formed so that the approximately horizontal section 4 of the conduit well is located above the base 9 of the target reservoir. The exact location of the approximately horizontal section 4 within the target reservoir will depend on the nature, depth and composition of the target reservoir, the hydrocarbons contained in the target reservoir, and the production process being used to extract such hydrocarbons from such reservoir. However the approximately horizontal section of the conduit well is formed in a direction and depth such that it is oriented towards the approximately horizontal section 3 of the main well.

In the practice of this invention, the approximately horizontal section of the conduit well does not physically come into contact with or intersect the approximately horizontal section of the main well. While the intersection of the approximately horizontal sections of each well does not occur, it is desirable that the distance between the approximately horizontal section of the main well and the approximately horizontal section of the conduit well, be as small as possible. The greater the distance between the approximately horizontal well-bores, the greater the difficulty of establishing and maintaining fluid communication between the wells. In actual practice, the maximum acceptable distance will depend on the nature, depth and composition of the target reservoir, the type of hydrocarbons contained in the target reservoir, the conduit substances, if any, associated with such hydrocarbons in the target reservoir, the prior production history of such reservoir and the type of production practices to be employed in producing hydrocarbons using the process and apparatus taught herein.

Before and during the forming of the conduit well, the production of fluids from the target reservoir through the main well commences and continues. In the forming of the conduit well, the forming of the approximately horizontal section 4 continues until circulation of drilling fluid is lost and drilling fluid used to form the conduit well is produced through the main well, or it is determined that the horizontal section 4 overlaps or has crossed the horizontal section 3 of the main well. It is preferred that the communication of fluids from the conduit well to the main well be confirmed by a portion of the drilling fluid used to form the conduit well, being produced through the main well. In many subterranean reservoirs, fluid communication will occur as a result of the natural permeability of the reservoir. In a target reservoir comprised of unconsolidated materials in order to establish and maintain substantial fluid communication between the main well and the conduit well, it is recommended, that fluids from the target reservoir be produced through the main well, for a period of time before the forming of the conduit well commences.

Where fluid communication is not established through the production of drilling fluids through the main well, during the forming of the conduit well, such fluid communication may occur over time by producing fluids through the main well. In such event the communication of fluids between the main well and the conduit well can be determined and confirmed by careful monitoring of fluid production volumes and rates from the main well. Fluid communication between the main well and the conduit well should be detected as an increase in the volume of fluid produced from the main well, beyond that which normally occur by the production of fluids from the main well alone, prior to the formation of the conduit well. As an added measure to confirm interwell fluid communication, an appropriate tracer fluid, such as a fluorescent dye or fluid containing a mild radioactive source, may also be placed in the well-bore of the conduit well, thereby confirming fluid communication between the main well and the conduit well when the tracer fluid is produced though the main well.

The length of time required to establish fluid communication in this manner, will vary, depending upon the nature, depth and composition of the target reservoir, the type of hydrocarbons contained in the target reservoir, and the additional substances, if any, associated with such hydrocarbons in the target reservoir, the prior production history of such reservoir and the type of production practices employed in producing hydrocarbons using the process and apparatus taught herein.

In this situation, to expedite the establishment of fluid communication, it is recommended that the approximately horizontal section 4 of the conduit well be formed so that it overlaps or crosses the approximately horizontal section 3 of the main well. If difficulty is encountered in obtaining fluid communication between the approximately horizontal section 3 of main well and the approximately horizontal section 4 of the conduit well, means known in the art may be employed to facilitate fluid communication between the two well by fracturing, displacing or removing a portion of the solid material which comprises the target reservoir and lies between the approximately horizontal sections of the two wells. This could include the use of techniques such as hydraulic fracturing, perforation or jet washing.

To further expedite the establishment of fluid communication it is recommended that the production of fluids from the target reservoir through the main well commence before attempting to form the conduit well, and should continue throughout the formation of such well. The length of time that the main well should be produced before attempting to form the conduit well, depends upon the nature, depth and composition of the target reservoir, the type of hydrocarbons contained in the target reservoir, and the additional substances, if any, associated with such hydrocarbons in the target reservoir, the prior production history of such reservoir and the type of production practices employed in producing hydrocarbons using the process and apparatus taught herein.

In the practice of this invention, the approximately horizontal section 4 of the conduit well acts as a conduit, thereby extending the area of the target reservoir which may be affected and produced from and through the main well. Therefore, the conduit well is not initially completed and equipped to produce substances from target reservoir. Only minimal completion work should be performed on the conduit well, to comply with good production practice and government regulation, and to prevent the well-bore from collapsing. However, fluids contained in the target reservoir must be able to flow or drain into the entire length of the approximately horizontal section of the conduit well. Therefore if possible, this section of the conduit well should either be left as "open hole" with no liner or completed with a perforated liner or other method of completion which allows fluids from the target reservoir to flow or drain into the entire length of such section 4. At surface 8 the conduit well is completed by the placement of a wellhead 11 at the surface outlet of the well.

Production tubing, pumps or other production equipment are not placed in the conduit well or on the well site of the conduit well at this time. As a result, a smaller permanent well site may be maintained for the conduit well. As stated previously, in applications where it is not necessary or desirable to access the horizontal section of the conduit well-bore subsequent to the forming of the conduit well-bore, it may be possible to complete the horizontal section of the conduit well-bore and abandon the build and vertical sections of the conduit well-bore. This would eliminate the need to construct or maintain a permanent well site for the conduit well-bore. Those skilled in the art will realize that this situation could arise where the prior production history of the target reservoir, the nature of the fluids contained therein, or the processes intended to be applied to produce substances from the target reservoir, require the conduit wells only as conduits.

If the conduit well is formed in the manner described above and the build and vertical sections of the conduit well are not abandoned, should at a later point in time, it become desirable to convert the conduit well into either a production of injection well, the well may be re-entered and the necessary equipment and tubing installed. In the practice of this invention, this should not be required except as specifically stated herein, or where the main well becomes unable to produce fluids from the target reservoir. Where the foregoing method is utilized to construct a network of several communicating horizontal wells, those skilled in the art will realize that this method and apparatus may be practiced by completing and equipping more than one but less than all of the wells in the network to produce or inject substances from or into the target reservoir.

Figure 2:
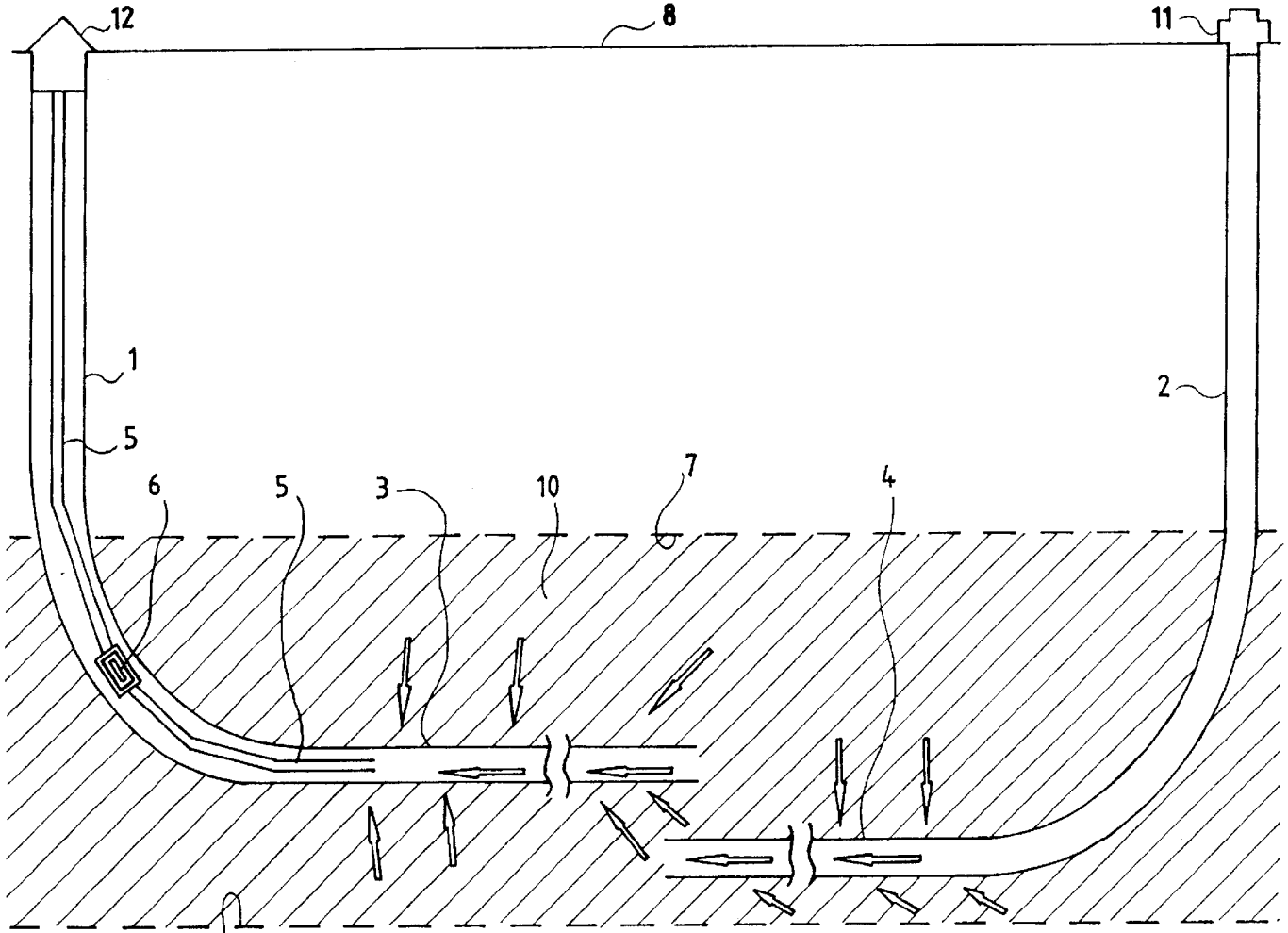
FIG. 2 shows, by side view, the approximate geometry of a simple horizontal well network formed in accordance with the present invention, where the two horizontal well-bores overlap but do not intersect.

In FIG. 1, main well and the conduit well are in fluid communication, without the approximately horizontal section 3 of main well crossing over or overlapping the approximately horizontal section 4 of the conduit well. Referring to FIG. 2, in this figure, the main well I and the conduit well 2 are in fluid communication, with the approximately horizontal section 3 of the main well crossing over or overlapping the approximately horizontal section 4 of the conduit well.

The orientation of the approximately horizontal section of the main well to the approximately horizontal section of the conduit well as illustrated in FIG. 1 and FIG. 2 is an exemplification only. In the practice of this invention, the actual orientation will vary according the limitations and requirements imposed or dictated by surface access for drilling locations; the nature, location and characteristics of the target reservoir; the equipment and methods employed to form each well; prior production methods and apparatus used to produce substances from the target reservoir; and the type of production processes to be employed using the network formed by the main well and the conduit well.

Furthermore it is not required that communication between the approximately horizontal section of the main well to the approximately horizontal section of the conduit well occur at the terminal ends of such horizontal sections, as illustrated in FIG. 1 and FIG. 2. Such illustrations are an exemplification only. Neither is the apparatus comprising this invention limited to only two wells.

Figure 3:
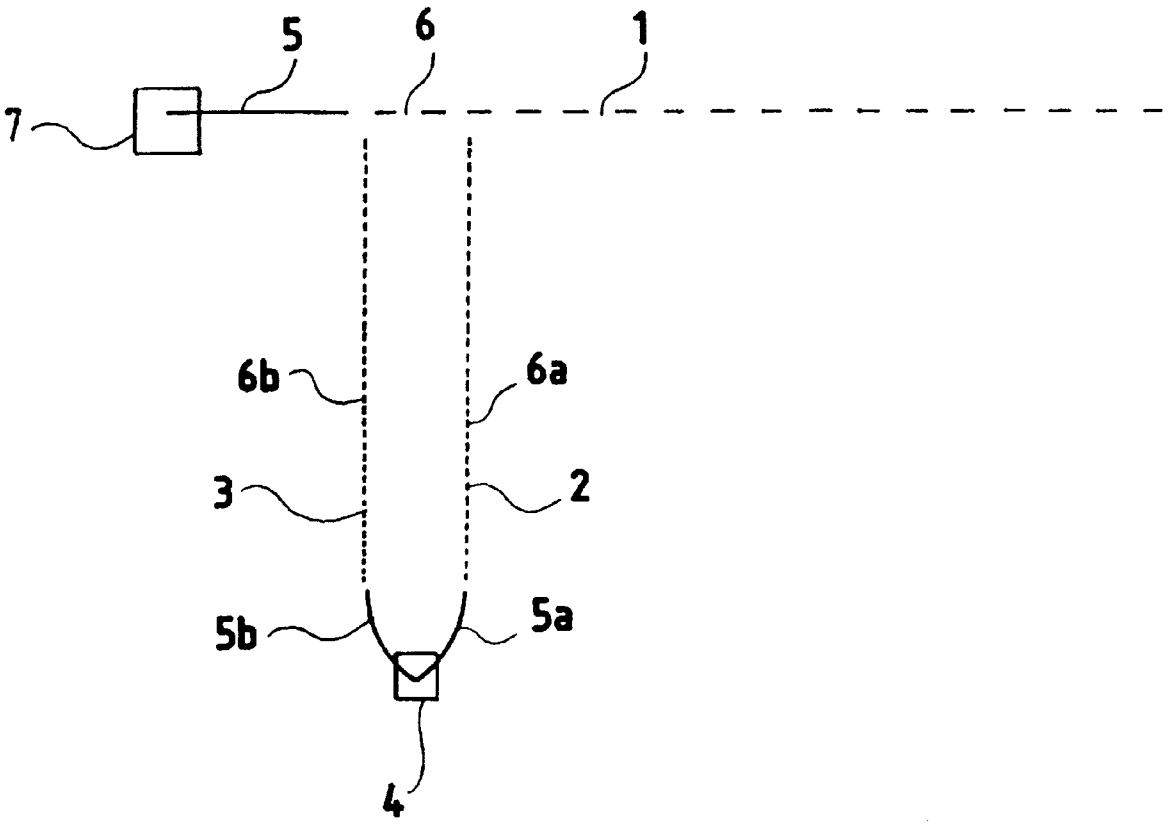
FIG. 3 shows, by overhead view, the approximate geometry of a simple horizontal well network formed in accordance with the present invention, where two horizontal well-bores communicate with the main producing well-bore, but do not overlap or intersect with the main producing horizontal well-bore.

Referring to FIG. 3., there is illustrated a network comprising 3 wells, with the main well, well 2 and well 3 ("the conduit wells"), each being formed from the surface of the earth, and comprised of a vertical and curved build angle section 5*a* and 5*b*, respectively and an approximately horizontal section 6*a* and 6*b*, respectively. The approximately horizontal section of each of the three wells in the network is located within the target reservoir. The main well is completed and equipped for the production of substances from the target reservoir. The conduit wells are completed only to the extent required by government regulation and good production practice. The conduit wells are not equipped for the injection or production of substances into or from the target reservoir. Thus the approximately horizontal sections of the conduit wells act as conduits, thereby extending the area of the reservoir which may be affected and produced from and through the main well.

A permanent well site 7 is constructed and maintained at the surface outlet of the main well. Only a small permanent well site 4 is required for the conduit wells, which pierce the surface of the earth at the same approximate location. As stated previously, it may also be possible to avoid constructing or maintaining a permanent well site for the conduit wells.

The conduit wells were formed subsequent to the formation, completion and equipping of the main well. Prior to and during the formation of the conduit wells, fluids are produced from the reservoir through the main well. The formation of the approximately horizontal section of each of the conduit wells ceases when drilling fluid used to form each such approximately horizontal section is produced through the main well, or such approximately horizontal section crosses over or overlaps the approximately horizontal section 6 of the main well, which ever event first occurs.

The conduit wells may be formed from a single well site and may be formed sequentially in any order, with one well being formed through conventional means immediately upon completion of work to form the first well in the pair. However the additional wells, may be formed from separate well sites. It is recommended that such wells be formed sequentially. This will help facilitate the confirmation of fluid communication between each of the conduit wells and the main well. Those skilled in the art will realize that it may be possible to form more than two conduit wells from the same well-site.

In the example illustrated in FIG. 3, the approximately horizontal sections of the wells do not overlap or cross.

Figure 4:
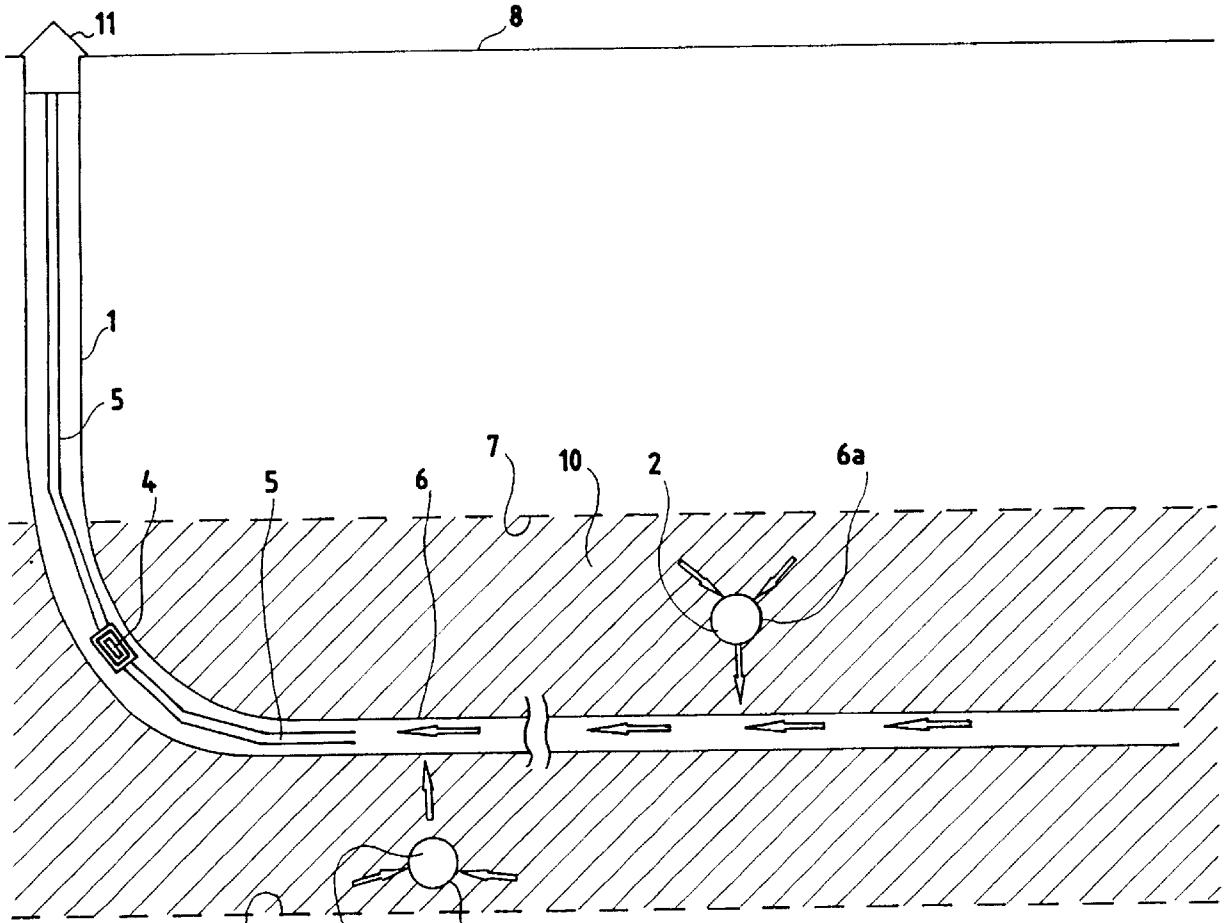
FIG. 4 shows, by side view and cross section, the approximate geometry of a simple horizontal well network formed in accordance with the present invention, where two horizontal well-bores cross over but do not intersect with a main producing horizontal well-bore.

Referring to FIG. 4, the approximately horizontal sections 6*a* and 6*b* of the conduit wells 2 and 3, cross over but do not intersect with the approximately horizontal section 6 of the main well. The approximately horizontal sections of all three wells lie within the target reservoir. In this example, the approximately horizontal section 6*a* of conduit well 2 has been formed between the top 7 of the target reservoir and the approximately horizontal section 6 of the main well. The approximately horizontal section 6*b* of the conduit well 3 has been formed between the bottom 8 of the target reservoir and the approximately horizontal section of the main well. In this example the approximately horizontal sections of the conduit wells cross over the approximately horizontal section of the main well, at approximately right angles.

Figure 5:
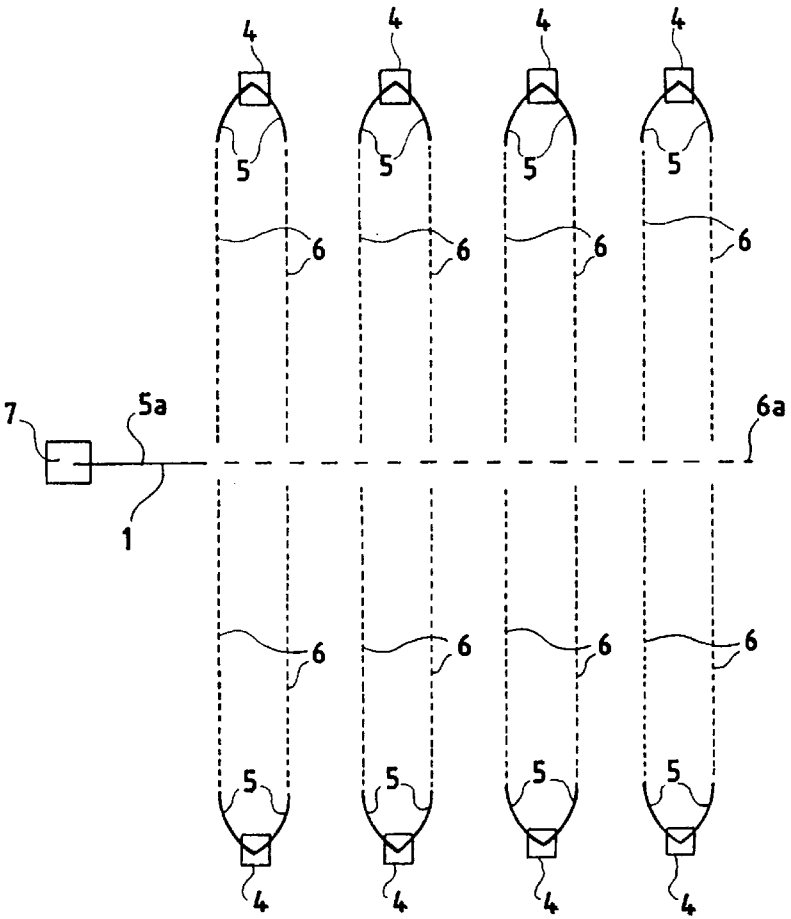
FIG. 5 shows, by overhead view, the approximate geometry of a horizontal well network formed in accordance with the present invention, where sixteen horizontal well-bores communicate with the main producing well-bore, but do not intersect with the main producing horizontal well-bore.

Referring to FIG. 5, the pattern illustrated in FIG. 3. could be extended to form a network of conduits constructed around the main well, with multiple conduit wells formed from small well sites 4 ("the small well-sites"), with each such conduit well consisting of vertical and curved build angle section 5, and an approximately horizontal section 6. The approximately horizontal sections of all wells shown in FIG. 5 lie substantially in the target reservoir. The approximately horizontal sections of the conduit wells are in fluid communication with the approximately horizontal section 6*a* of the main well. However while the approximately horizontal sections of the conduit wells may cross over or overlap the approximately horizontal section of the main well, they do not physically intersect or connect with the approximately horizontal section of the main well. The conduit wells are formed in sequence after the formation of the main well. Prior to and during the forming of the conduit wells substances are produced from the target reservoir though main well.

All of the conduit wells may be formed immediately in sequence or over a period of time. The sequence and timing for forming each such conduit well will vary according to the limitations and requirements imposed or dictated by: (i) surface access for drilling locations; (ii) the nature, location and characteristics of the target reservoir; (iii) the equipment and methods employed to form each well; (iv) the prior production methods and the apparatus previously used to produce substances from the target reservoir; and (v) the production processes to be employed using the network formed by the main well and the conduit wells. It is recommended that the conduit wells, be formed in order of the proximity that the approximately horizontal section 6 of each of the conduit wells will have to the vertical section/build angle section of the main well, with those wells in closest proximity thereto being formed first.

As before, only the main well is initially completed and equipped to produce substances from the target reservoir. A large permanent well site 7 is constructed and maintained for the main well. Permanent access is also constructed to this well site . The small well sites may be smaller than well site 7, as the conduit wells, are not initially equipped for the production of substances from the target reservoir. As stated previously, it may be possible to avoid constructing or maintaining a permanent well sites for the conduit wells if it is not necessary or desirable to re-enter or access the well-bores of the conduit wells subsequent to the forming and completion of such well-bores.

The approximately horizontal section 6 of each of the conduit wells acts only as conduit in the reservoir facilitating the flow of fluids contained in the reservoir to the well-bore of the main well. As the approximately horizontal sections of the conduit wells are in fluid communication with the approximately horizontal section 6*a* of the main well, they extend the area of the reservoir accessed and affected by the main well.

FIGS. 1 through to 5 illustrate a network of 2 or more wells where the approximately horizontal section of the main well communicates directly with the approximately horizontal section of every other well in the network. The main well thus utilizes the approximately horizontal sections of all other wells in the network as conduits, to access and affect a larger portion of the target reservoir.

Figure 6:
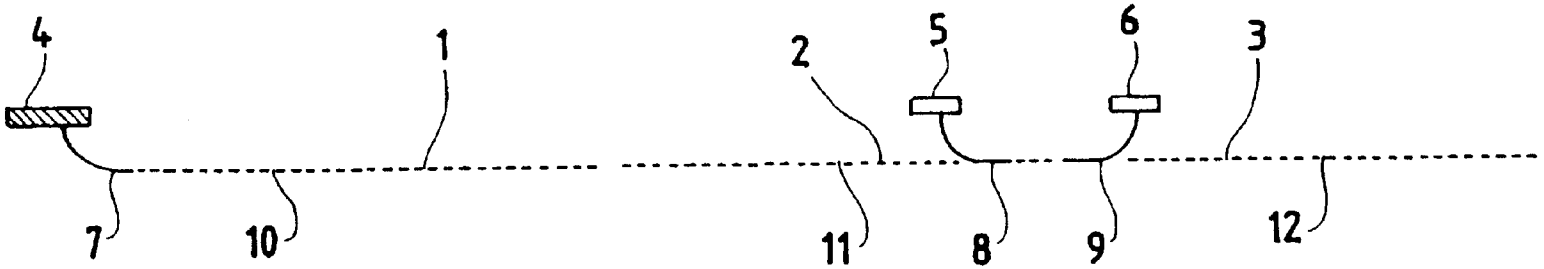
FIG. 6 shows, by side view, the approximate geometry of a simple horizontal well network formed in accordance with the present invention, where three horizontal well-bores communicate with the main producing well-bore, but do not intersect with the main producing horizontal well-bore and one of the well-bores communicates indirectly with the main producing well-bore through the other well-bore.
Figure 7:
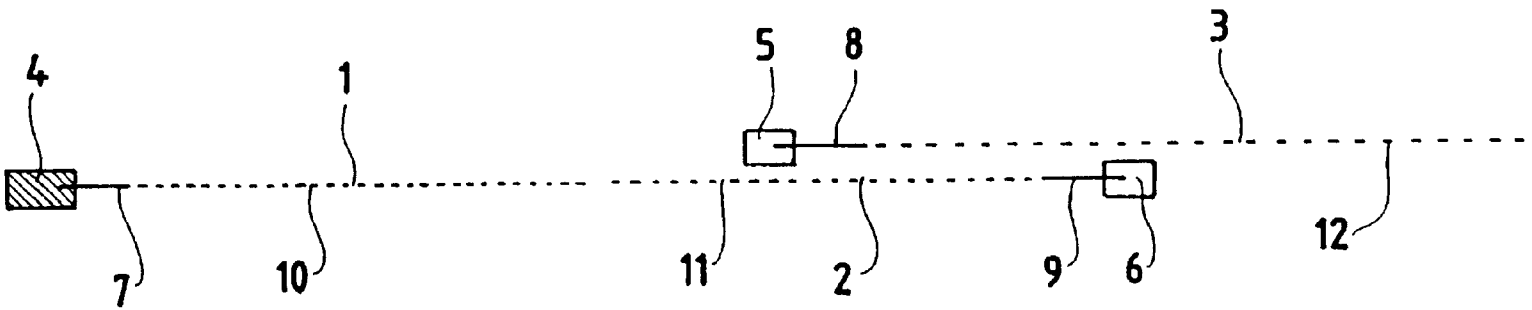
FIG. 7 shows, by overhead view, the approximate geometry of the simple horizontal well network represented in FIG. 6.

Referring to FIGS. 6 and 7, it is possible to construct a network of communicating wells achieving the same result, without having each conduit well communicating directly with the main well which has been equipped to produce substances from the target reservoir. FIGS. 6 and 7 illustrate a network consisting of 3 horizontal wells, with the main well 1, being formed first, from well site 4, and consisting of a vertical section/build angle section 7 and an approximately horizontal section 10 located substantially in the target reservoir. The main well is completed and equipped for the removal of substances from the target reservoir. Except as stated below, the main well is placed on production for a period of time prior to and at substantially all times during the forming of the other wells in the network. Conduit well 2 is formed after the main well, from well site 6, and consists of a vertical section/build angle section 9 and an approximately horizontal section 11 located substantially in the target reservoir. Prior to the formation of conduit well 3, the well network comprised of the main well and conduit well 2, looks approximately as illustrated by FIG. 1 or FIG. 2, depending on whether the approximately horizontal sections of these wells overlap.

Conduit well 3 is formed after conduit well 2, from well site 5, and consists of a vertical section/build angle section 8 and an approximately horizontal section 12 located substantially in the target reservoir. The forming of conduit well 3 should not commence until fluid communication between the approximately horizontal sections of the main well and conduit well 2, has been establish.

When formed, the approximately horizontal section of conduit well 3 is not in direct fluid communication with the approximately horizontal section of the main well. Fluid contained in the target reservoir which enters the approximately horizontal section of conduit well 3, passes through the approximately horizontal section of conduit well 2 to reach the approximately horizontal section of the main well. Therefore the approximately horizontal section of conduit well 3, is formed such that it is in fluid communication with the approximately horizontal section of conduit well 2. In forming conduit well 3, if fluid communication with conduit well 2 occurs during the forming of conduit well 3 through the loss of drilling fluid circulation and the production of such fluid through the main well, production of fluid from the reservoir through main well must immediately cease, to allow the forming of conduit well 3 to continue until the approximately horizontal section of conduit well 3 is formed to the length desired. Once the formation of conduit well 3 is complete, production of fluids through the main well recommences.

Figure 8:
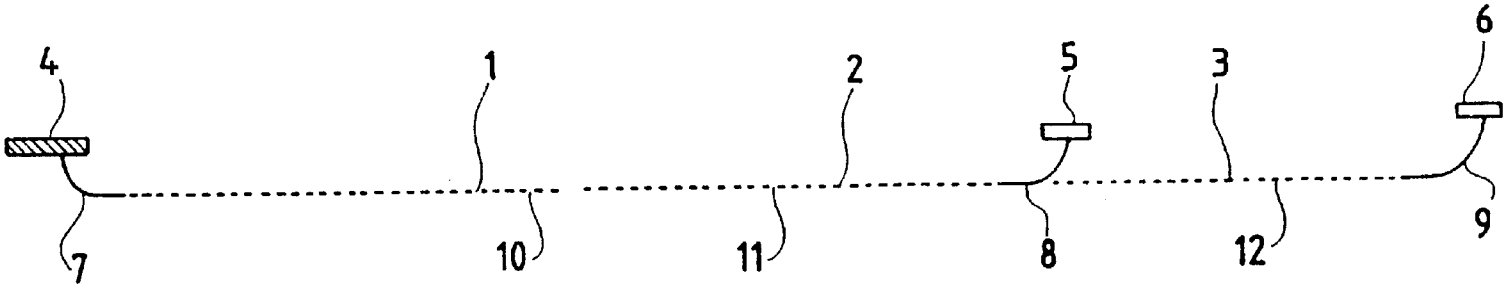
FIG. 8 shows, by side view, the approximate geometry of a simple horizontal well network formed in accordance with the present invention, where three horizontal well-bores communicate with the main producing well-bore, but do not intersect with the main producing horizontal well-bore and one of the well-bores communicates indirectly with the main producing well-bore through the other well-bore and all of the well-bores have been formed with the same approximate alignment.
Figure 9:
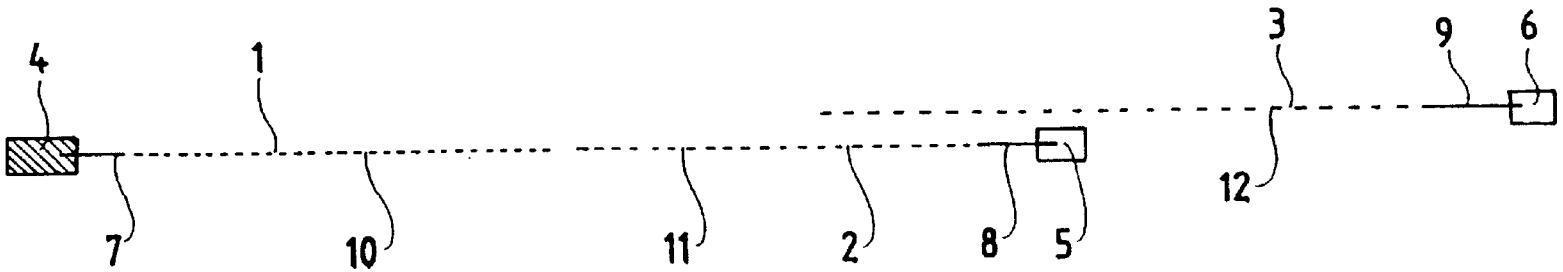
FIG. 9 shows, by overhead view, the approximate geometry of the simple horizontal well network represented in FIG. 8.

The three well network represented in FIG. 6 and FIG. 7, could also be constructed as illustrated in FIG. 8 and FIG. 9, with conduit well 3 formed and oriented in the approximate same direction as conduit well 2. If the network is constructed to reflect the illustration in FIG. 8 and FIG. 9, conduit well 3 would be formed as prescribed for the network illustrated in FIG. 6 and FIG. 7, save and except that the production of substances from the reservoir through the main well does not cease if drilling fluid used to form conduit well 3 is communicated to and is produced through the main well, and the forming of conduit well 3 ceases when such communication occurs.

Referring to FIG. 6, FIG. 7, FIG. 8 and FIG. 9, initially, conduit well 2 and conduit well 3 are not equipped to produce substances from the target reservoir. As in the previous examples these wells act only as conduits allowing a larger portion of the target reservoir to be accessed and affected by the main well. The conduit wells are completed to the extent required by government regulation, the art and good production practice. Subject to government regulation and the production process to be employed to remove substances from the target reservoir using the well network comprised of the three wells represented in FIG. 6, FIG. 7, FIG. 8 and FIG. 9, it may be possible to avoid having to maintain permanent surface access to well sites 4 and 5. Also it may be possible to avoid constructing or maintaining permanent well sites for the conduit wells if it is not necessary or desirable to re-enter or access the well-bores of the conduit wells subsequent to the forming and completion of such well-bores.

Figure 10:
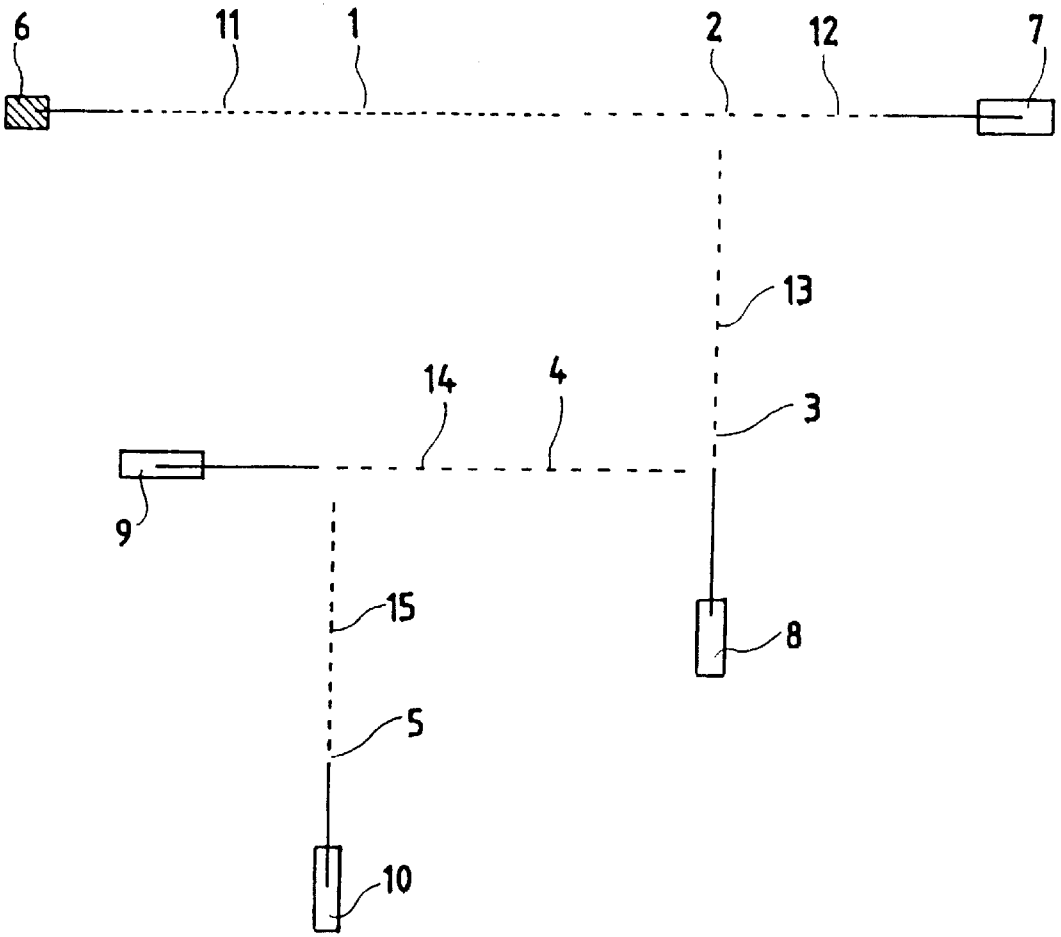
FIG. 10 shows, by overhead view, the approximate geometry of a horizontal well network formed in accordance with the present invention, where one horizontal well-bore communicates directly with the main producing well-bore and three horizontal well-bores communicate indirectly with the main producing well-bore, and none of the well-bores intersect.

The network of wells represented by the illustrated in FIG. 6, FIG. 7, FIG. 8 and FIG. 9 can be further extended subsequent to the forming of conduit well 3, by the forming of additional wells in the manner of conduit well 3, with each additional well indirectly communicating with the main well, through the approximately horizontal sections of the wells in the network formed previously. The extension of the network in this manner can take a variety of forms. Illustrated in FIG. 10 is one hypothetical network of wells formed in this manner. The main well I is formed from permanent well site 6 and is equipped to produce substances from the target reservoir. Conduit wells 2, 3, 4 and 5 are formed from well sites 7, 8, 9 and 10, respectively. The conduit wells are not initially equipped to produce substances from the target reservoir. The approximately horizontal section 12 of conduit well 2 is in fluid communication with the approximately horizontal section 11 of the main well. The approximately horizontal section 13 of conduit well 3 is in fluid communication with the approximately horizontal section of conduit well 2, and therefore in indirect fluid communication with the approximately horizontal section of the main well. The approximately horizontal section 14 of conduit well 4 is in fluid communication with the approximately horizontal section of conduit well 3, and therefore in indirect fluid communication with the approximately horizontal section of the main well through the approximately horizontal sections of conduit wells 2 and 3 respectively. The approximately horizontal section 15 of conduit well 5 is in fluid communication with the approximately horizontal section of conduit well 4, and therefore in indirect fluid communication with the approximately horizontal section of the main well through the approximately horizontal sections of conduit wells 2, 3 and 4 respectively.

The well networks illustrated and described herein represent only a small number of the possible networks of communicating wells which may be constructed and operated in the manner described herein. Those skilled in the art will realize that it is possible to construct a significantly larger variety of patterns and layouts using the foregoing described methods and apparatus.

A network of communicating wells constructed in the fashion described herein may be used to apply a variety of production processes known in the art. For example, referring to all of the figures attached hereto, in a target reservoir containing crude oil which can be produced only by the employment of artificial lift technologies, the main well is the only well in the network which is equipped with artificial lift equipment. This invention may also be practiced by equipping and operating more than one, but less than all wells in the network.

In a target reservoir containing heavy crude oil or bitumen which can only be produced by the injection of steam or other fluids into the reservoir in order to mobilize the viscous oil contained therein, the main well may be completed and equipped to both inject and produce substances from the target reservoir. In the previous examples, all wells in the network other than main well act merely conduits to extend the area of the reservoir affected and accessed by the main well. Those skilled in the art will realize the possible uses of a network of communicating horizontal well-bores formed and operating in this matter.

One of the unique advantages of this invention is the production of a large area of a target reservoir, using a number of horizontal wells simultaneously as a network of communicating well-bores, without the necessity equipping each well to produce substances from the reservoir. This can reduce the cost of producing substances from the target reservoir. Further cost savings can be achieved in applications where it is not necessary or desirable to access the approximately horizontal section of a conduit well subsequent to the forming of such well. In these situations it may be possible to complete the approximately horizontal section of such conduit well and abandon the build and vertical section of such well. This would eliminate the need to construct or maintain a permanent sell site for such conduit well.

However if the build and vertical section of the conduit well are not abandoned it may be possible to quip the conduit well to inject or produce substances to or from the target reservoir, at a future point in. For example should the main well fail or become disabled beyond the point of economic repair, one of the conduit wells in the network could be equipped to replace the main well as the well used to inject or produce substances to or from the reservoir.

As a further embodiment of this invention, it is possible to employ a network of communicating horizontal wells formed in the manner described above, to produce substances from a target reservoir using any process that involves the injection of fluids into the reservoir, and the production of fluids from the reservoir, in a cyclic fashion. The first well formed is completed and equipped as taught above, to both inject substances into and produce substances from the target reservoir. Additional wells formed as part of the network are not initially equipped to produce substances from the reservoir. However the additional wells could also be equipped as injection wells as they are formed. This would allow the injection a larger amount of fluid into the reservoir over a larger area of the reservoir, than could be accessed by a single injection well.

The exact manner of operation of the well network constructed in this fashion will vary, depending on the limitations and requirements imposed or dictated by the composition, location and characteristics of the target reservoir; the type of substances contained in the target reservoir; prior production methods and apparatus used to produce substances from the target reservoir; and the type of production processes to be employed using the network. Many variations are possible. However as one example to illustrate the principles outlined in this regard, a network of communicating wells constructed as represented in FIG. 5, could be used to conduct a cyclic steam stimulation process to produce heavy viscous fluids, such as bitumen or heavy crude oil, from the target reservoir. To accomplish this, the network would be constructed in the manner described above, with the additional steps of (i) equipping the main well to both inject substances into and produce substances from the target reservoir; and (ii) equipping the conduit wells to inject substances into the target reservoir. In operating the network, steam would be injected through all wells in the network simultaneously using means known in the art, without any production of fluids from the reservoir occurring during such injection phase. Upon cessation of such steam injection, with such period of injection and the point of cessation being determined in accordance with injection practices known in the art, all wells in the network would be shut in for a period of time to allow heat from the injected steam to be distributed through the reservoir and the previously viscous fluids contained therein. The length of this "soak" period would be determined according the practice for this production technique, as known in the art. Upon cessation of this "soak" period, the production of fluids from the reservoir, through the main well would commence and continue until it became economically or physically impractical to continue such fluid production. This would be determined according to the practices known in the art for the conduct of cyclic steam injection processes. At this point the cycle of injection, "soak" and production would be repeated.

The practice of this invention in this manner allows for a larger area of the target reservoir to be affected and produced through a network of communicating wells, without all wells in the network having to be equipped to both inject and produce substances from the target reservoir. Further, the wells in the network which are equipped only to inject fluids into the reservoir, will generally require a smaller permanent well site than wells which are equipped to produce fluids as well. The initial equipping of any well in the network only as an injector, does not preclude re-equipping an such well at a later point in time as both a producer and injector.

This embodiment could be practiced with more than one but less than all wells in the network being equipped and operated to produce fluids from the target reservoir. Also this embodiment could be practiced by injecting fluids other than or in addition to steam. This could include fluids, at various temperatures, in liquid, gaseous or multiphase form, such as a hydrocarbon, a solvent, water, carbon dioxide, an acid, a base, a solution, a leaching fluid or a fluid containing a solid held in suspension, or a mixture of two or more substances from within such group. The type, temperature and state of the fluid selected as the injection fluid will depend upon the nature, depth and composition of the target reservoir, and the type of substances contained in the target reservoir to be produced as a result of such fluid injection. Means of making such selection are well known in the art. With the injection of a variety of fluids being possible, those skilled in the art will realize that this embodiment could be practiced to produce a variety of hydrocarbons contained in a subterranean reservoir. Those skilled in the art will also realize, that it is possible to use a network of approximately horizontal well-bores formed in the manner of this invention, to produce solid minerals contained in a subterranean formation, which can be dissolved or reduced to solution or suspension.

In summary, this invention comprises a method of and apparatus for producing fluids from a subterranean formation containing such fluids comprising the steps of:

a) forming a well-bore having a horizontal section that is located within the formation and completing and equipping the well-bore so that fluids contained in the formation can be produced from the formation through the well-bore;

b) producing fluids from the formation through such well-bore and preferably while producing such fluids, forming at least one additional well-bore having a horizontal section that is located within the formation, such that the horizontal section of the said at least one additional well-bore is in fluid communication with the well-bore formed pursuant to step (a) without intersecting with such well-bore; and c) at least completing but not equipping the at least one additional well-bore, and using such at least one additional well-bore as an conduit within the formation to allow and cause fluids contained in the formation which drain or flow into such at least one additional well-bore to flow to and be produced through the well-bore formed pursuant to step (a) above.

d) repeating steps (b) and (c) by forming, completing and utilizing further additional well-bores as conduits within the formation to allow and cause fluids contained in the formation which drain or flow into such further additional well-bores to flow to and be produced formed the well-bore formed pursuant to step (a) above.

This network of communicating horizontal well-bores can used to produce substances through a cyclic injection and production process, by including the additional step of equipping all well-bores, for the injection of fluids into the formation and utilizing said well-bores to simultaneously inject fluids into the formation, in order to mobilize fluids contained in the formation. In the practice of this invention more than one, but less than all wells, may be equipped to produce fluids from the reservoir.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, materials, size and arrangement of parts. Moreover, equivalent techniques and steps (taken individually or together) may be substituted for those illustrated and described. Also certain features of the invention may be used independently of other features of the invention. For example, the present invention is not limited to production of hydrocarbons but could be used to produce any substance contained within a subterranean formation which could otherwise be produced from a bore-hole formed from the surface of the earth. The present invention could be used to produce minerals which could be extracted using horizontal wells and a wash or leaching process. Also those embodiments of the present invention which facilitate the injection of substances or include the use of any injection fluid or substance suspended in a fluid which would be desirable to use in a process to produce substances from a subterranean formation. Reference to any specific application of the invention described above, is by way of example only. In applying the process of the invention, consideration must be given to: (i) the type, location and composition of the target reservoir; (ii) the type and composition the substances being sought, contained in such reservoir; (iii) any prior production methods and apparatus previously used to produce substances from the target reservoir; and (iv) the type of production processes to be employed using the network of wells. Thus, the present invention should not be limited by the details specified or by the specific embodiments chosen to illustrate the invention or the drawings attached hereto. Thus, it will be appreciated that such modifications, alternatives, variations, and changes may be made without departing from the spirit and scope of the invention as defined in the appended claims.

What is claimed is:

1. A method of producing fluids from a subterranean formation containing such fluids, comprising a network of conduits formed and operated according to the following steps:

(a) forming a well-bore having a horizontal section that is located within the formation;

(b) completing and equipping the well-bore so that fluids contained in the formation can be produced from the formation through the well-bore;

(c) producing fluids from the formation through the well-bore characterized by:

(d) forming at least one additional well-bore having a horizontal section that is located within the formation, such that the horizontal section of said at least one additional well-bore is oriented in the direction of the horizontal section of the well-bore formed pursuant to step (a), and is in fluid communication with the well-bore formed pursuant to step (a), without intersecting with such well-bore; and (e) at least completing the at least one additional well-bore, to form a conduit within the formation to allow and cause fluids contained in the formation which drain or flow into such at least one additional well-bore to flow to and be produced from the well-bore formed pursuant to step (a) above;

wherein performing step (d) fluid communication between the well-bore Pursuant to step (a) occurs during the forming of said at least one additional well-bore.

2. The method as set forth in claim 1, where in performing step (d) the production of substances from the formation through the well-bore formed pursuant to step (a) continues.

3. The method as set forth in claim 1, where in performing step (d) said fluid communication is created by fracturing, perforating, washing away or removing a portion of the material comprising the reservoir lying between the horizontal section of the at least one additional well-bore and the horizontal section of the well-bore formed pursuant to step (a).

4. The method as set forth in claim 1, where in performing step (d) the horizontal section of the at least one additional well-bore is formed so that such section overlaps with or crosses over the horizontal section of the well-bore formed pursuant to step (a), without intersecting the horizontal section such well-bore.

5. The method as set forth in claim 1, where in performing step (b) said well-bore is also equipped for the purpose of injecting substances into the formation and is used to inject substances into the formation.

6. The method as set forth in claim 1, wherein all well-bores formed pursuant to steps (a) and (d) are equipped to inject substances into the formation used to conduct a cyclic fluid injection and production process to produce fluids from the formation comprising the following steps:

(i) injecting a fluid into the formation, through the well-bore formed in step (a), to mobilize the fluids already contained in the formation;

(ii) ceasing the injection of fluid and shutting the well network in for a period of time;

(iii) producing fluids from the formation through the well-bore formed in step (a) of claim 1; and (iv) repeating steps (i), (ii) and (iii), in a continuous cycle until further production of fluids from the formation is no longer desirable.

7. The method as set forth in claim 6, where in performing step (i) said injected fluid comprises at least one of the group comprising a hydrocarbon, a solvent, water, steam, carbon dioxide, an acid, a base, a solution, a leaching fluid or a fluid containing a solid held in suspension, a liquid, a gas, a multiphase fluid or a mixture of two or more substances from within such group.

8. The method as set forth in claim 6, wherein said injection fluid is heated and injected into the formation at a temperature higher than the temperature of the formation.

9. The method as set forth in claim 6, wherein prior to performing step (i), the at least one additional well-bore is equipped to inject substances into the formation, and wherein step (i) comprises simultaneously injecting a fluid into the formation, through the well-bore formed in step (a) of claim 1 and the at least one additional well-bore, to mobilize the fluids already contained in the formation.

10. The method as set forth in claim 1, where in performing step (d) at least two well-bores are formed sequentially and immediately one after the other.

11. The method as set forth in claim 1, where in performing step (d) at least two well-bores are formed sequentially one after the other.

12. A method of producing fluids from a subterranean formation containing such fluids, comprising a network of conduits formed and operated according to the following steps:

(a) forming a well-bore having a horizontal section that is located within the formation;

(b) completing and equipping the well-bore so that fluids contained in the formation can be produced from the formation through the well-bore;

(c) producing fluids from the formation through the well-bore characterized by:

(d) forming at least one additional well-bore having a horizontal section that is located within the formation, such that the horizontal section of said at least one additional well-bore is oriented in the direction of the horizontal section of the well-bore formed pursuant to step (a), and is in fluid communication with the well-bore formed pursuant to step (a), without intersecting with such well-bore; and (e) at least completing the at least one additional well-bore, to form a conduit within the formation to allow and cause fluids contained in the formation which drain or flow into such at least one additional well-bore to flow to and be Produced from the well-bore formed pursuant to step (a) above;

wherein such fluid communication is created by performing step (c).

13. The method of producing mineral substances from a subterranean formation containing such substances comprising the steps of:

(a) forming a well-bore having a horizontal section that is located within the formation and completing and equipping the well-bore so that substances contained in the formation can be produced from the formation through the well-bore characterized by:

(b) sequentially or simultaneously forming further additional well-bores each having a horizontal section that is located within the formation, such that the horizontal section of each said further additional well-bores is in direct or indirect fluid communication with the well-bore formed pursuant to step (a), without intersecting with any other well-bore, wherein such fluid communication is created by producing fluids from the formation through the well-bore formed pursuant to step (a) or by fracturing, perforation, washing away or removing a portion of the material comprising the reservoir lying between the horizontal section of at least one of such additional well-bores and the horizontal section of the well-bore formed pursuant to step (a);

(c) at least completing the well-bores formed pursuant to step (b) and using such well-bores as conduits within the formation to allow and cause fluids contained in the formation which drain or flow into such well-bores to flow to and be produces through the well-bore formed pursuant to step (a) above, and producing fluids from the formation through the well-bore formed pursuant to step (a); and (d) equipping all well bores, for the infection of one or more fluids into the formation and utilizing said well-bores to simultaneously infect one or more fluids from the group comprising a hydrocarbon, a solvent, water, steam, carbon dioxide, an acid, a base, a solution, a leaching fluid or a fluid containing a solid held in suspension, a liquid, a gas, a multiphase fluid or a mixture of two or more substances from within such group, into the formation, in order to mobilize substances contained in the formation, in the conduit of a cyclic infection and production process, using only at least one but less than all such well-bores to Produce fluids from the formation in the conduct of such process.

14. The method of claim 13, wherein at least one existing well-bore having a horizontal section that is located within the formation, that was previously formed and at least completed, is used in place of or in addition to a well-bore formed pursuant to at least one of steps (a) and (b).

15. The method of claim 13, wherein at least two, but less than all of the well-bores formed pursuant to such claim are equipped and used to produce fluids from the formation.

16. The method of claim 13, wherein the injection fluid is heated above the temperature of the formation prior to injection into the formation.

17. The method of claim 13, wherein the substance contained in the formation is a solid mineral and the fluid being injected dissolves such mineral or carries such mineral in suspension through a wash or leaching process.

* * * * *

UNITED STATES PATENT AND TRADEMARK OFFICE

CERTIFICATE OF CORRECTION

PATENT NO. : 6,729,394 B1 
DATED : May 4, 2004
INVENTOR(S) : David J. Hassan, Michael D. Chernichen and Earl M. Jensen It is certified that error appears in the above-identified patent and that said Letters Patent is hereby corrected as shown below:

Column 3,
Line 3, “pp. 5942.” should read -- pp. 59-62. --
Line 6, “pp. 6549.” should read -- pp. 65-69. --

Column 5,
Line 42, “that one o the major” should read -- that one of the major --

Column 20,
Line 23, “well-bore Pursuant to step (a)” should read -- well-bore pursuant to step (a) --

Signed and Sealed this

Thirteenth Day of July, 2004

JON W. DUDAS
*Acting Director of the United States Patent and Trademark Office*